US011308750B1

(12) United States Patent
Zorick et al.

(10) Patent No.: US 11,308,750 B1
(45) Date of Patent: Apr. 19, 2022

(54) APPARATUS AND METHOD FOR SPORTING EQUIPMENT STICK VENDING

(71) Applicants: Broderick Zorick, Beaverton, OR (US); Kevin Roudebush, Beaverton, OR (US)

(72) Inventors: Broderick Zorick, Beaverton, OR (US); Kevin Roudebush, Beaverton, OR (US)

(73) Assignee: V4HOCKEY LLC, Salem, OR (US)

( * ) Notice: Subject to any disclaimer, the term of this patent is extended or adjusted under 35 U.S.C. 154(b) by 0 days.

(21) Appl. No.: 17/464,353

(22) Filed: Sep. 1, 2021

Related U.S. Application Data

(60) Provisional application No. 63/086,902, filed on Oct. 2, 2020.

(51) Int. Cl.

| | |
|---|---|
| ***G07F 17/00*** | (2006.01) |
| ***G07F 5/26*** | (2006.01) |
| ***G07F 17/32*** | (2006.01) |

(52) U.S. Cl.
CPC ..... *G07F 17/0042* (2013.01); *G07F 5/26* (2013.01); *G07F 17/32* (2013.01)

(58) Field of Classification Search
CPC ..... G07F 17/0042; G07F 5/26; G07F 17/32
See application file for complete search history.

(56) References Cited

U.S. PATENT DOCUMENTS

| | | | | |
|---|---|---|---|---|
| 3,129,039 | A * | 4/1964 | Staley | G07F 11/54 312/97.1 |
| 4,311,227 | A * | 1/1982 | Watkins | G07F 11/62 194/206 |
| 6,123,223 | A * | 9/2000 | Watkins | G07F 17/00 108/21 |
| 6,227,407 | B1 * | 5/2001 | Simeri | B65G 47/1471 221/192 |
| 9,240,092 | B2 * | 1/2016 | Zorick | A63B 59/70 |
| 2005/0269768 | A1 * | 12/2005 | Singer | G07F 17/32 273/138.1 |
| 2010/0028501 | A1 * | 2/2010 | Baxter | A23G 9/28 426/231 |
| 2013/0253700 | A1 | 9/2013 | Carson et al. | |
| 2014/0332551 | A1 * | 11/2014 | Zorick | G07F 11/54 221/121 |
| 2015/0008236 | A1 | 1/2015 | Mills et al. | |
| 2019/0355202 | A1 | 11/2019 | Navarro Bonilla et al. | |

* cited by examiner

*Primary Examiner* — Michael Collins

(57) ABSTRACT

A system for dispensing sporting equipment sticks is provided. Embodiments have a controller that generates a release signal in response to a user completing a purchase of a selected sporting equipment stick that is secured within the sporting equipment stick vending machine; a plurality of securing latches each defining a lockable compartment that receives a portion of a shaft of a sporting equipment stick, and wherein each one of the plurality of securing latches open to release its respective sporting equipment stick in response to the release signal received from the controller; and a stick guide system with a plurality of restraining apertures that are configured to receive a portion of a handle of the sporting equipment stick, wherein a size of reach restraining aperture is sized to receive a proximal end of the sporting equipment stick. The securing latch and corresponding restraining aperture cooperatively secure the sporting equipment stick.

19 Claims, 9 Drawing Sheets

APPARATUS AND METHOD FOR SPORTING EQUIPMENT STICK VENDING

PRIORITY CLAIM

This application claims priority to U.S. Application, Ser. No. 63/086,902, filed on Oct. 2, 2020, entitled Apparatus and Method For Tool Vending, which is hereby incorporated by reference for all purposes.

BACKGROUND OF THE INVENTION

In the arts of providing products using vending machines, and in particular in providing sports equipment such as hockey sticks to players, a hockey player must go to a retail outlet to obtain their hockey stick. Alternatively, a hockey stick may be ordered on line and later delivered to the player by mail.

However, during play of a hockey game at an ice rink, if the hockey stick is damaged or cannot be used, a replacement hockey stick will be required. Because of overhead costs, only the largest and busiest ice rinks (hockey rinks) will have an on-site retail outlet that can provide a replacement hockey stick to a player in need. If the retail outlet is closed, or if there is no retail outlet present such as at smaller ice rinks, a replacement hockey stick will not be readily available.

Similar situations may be encountered at facilities that host other sports, such as at tennis courts, golf courses, baseball fields, lacrosse fields, field hockey fields, etc. Here, players may encounter similar difficulties in obtaining tennis racquets, golf clubs, cricket bats, baseball bats, lacrosse sticks, field hockey sticks, etc.

Accordingly, there is a need in the arts for an improved apparatus and method to provide immediate on-site access to sporting equipment, such as a hockey stick at an ice arena.

BRIEF DESCRIPTION OF THE DRAWINGS

The components in the drawings are not necessarily to scale relative to each other. Like reference numerals designate corresponding parts throughout the several views.

SUMMARY OF THE INVENTION

Embodiments of the sporting equipment stick vending machine provide a system and method for dispensing sporting equipment sticks to a purchasing user. Embodiments have a controller that generates a release signal in response to a user completing a purchase of a selected sporting equipment stick that is secured within the sporting equipment stick vending machine; a plurality of securing latches each defining a lockable compartment that receives a portion of a shaft of a sporting equipment stick, and wherein each one of the plurality of securing latches open to release its respective sporting equipment stick in response to the release signal received from the controller; and a stick guide system with a plurality of restraining apertures that are configured to receive a portion of a handle of the sporting equipment stick, wherein a size of reach restraining aperture is sized to receive a proximal end of the sporting equipment stick. The securing latch and corresponding restraining aperture cooperatively secure the sporting equipment stick.

DETAILED DESCRIPTION

Figure 1:
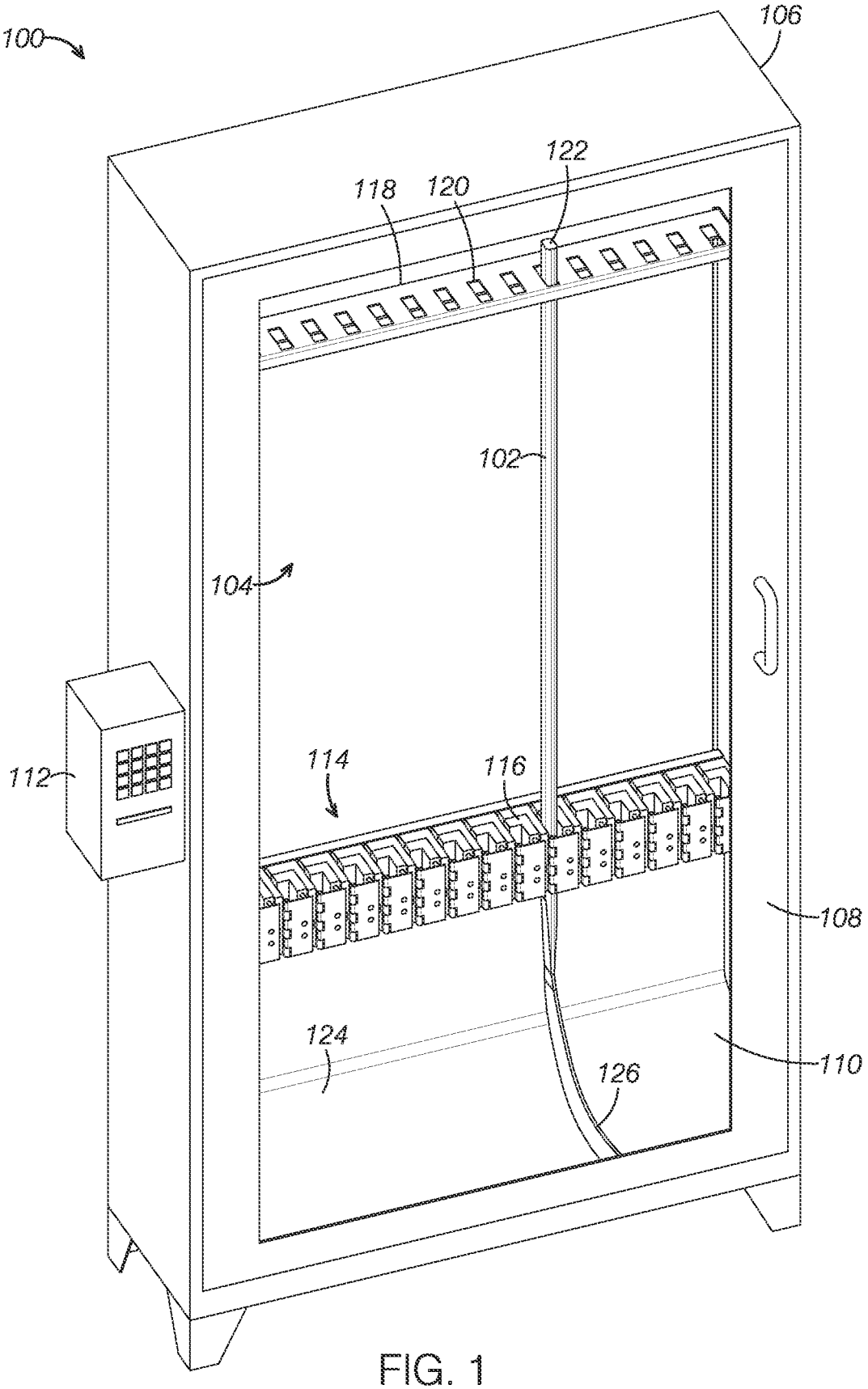
FIG. 1 is a perspective front view of an embodiment of a sporting equipment stock vending machine configured to provide an example hockey stick to a purchasing player.

FIG. 1 is a perspective front view of an embodiment of a sporting equipment stick vending machine 100 configured to provide an example hockey stick 102 to a purchasing player. Embodiments of the sporting equipment stick vending machine 100 provide a system and method for dispensing sporting equipment sticks, such as the example hockey stick 102, to a purchasing player. For convenience and brevity, a single hockey stick 102 is illustrated as residing in the sporting equipment stick vending machine 100. The sporting equipment stick vending machine 100 is configured to secure a plurality of sporting equipment sticks, wherein individual sporting equipment sticks can be released in response to a purchase by a person.

To conceptually describe operation of the sporting equipment stick vending machine 100, the vending machine 100 is described and illustrated as being configured to dispense hockey sticks. It is appreciated that alternative embodiments may be configured to provide other various types of sporting equipment sticks to players (users) using the novel sporting equipment stick vending machine 100. For example, but not limited to, embodiments of the vending machine 100 may dispense tennis racquets, golf clubs, cricket bats, baseball bats, lacrosse sticks, field hockey sticks, etc.

The sporting equipment stick vending machines 100 may be located at the facility where the sporting event where players use a sporting equipment stick is played, such as, but not limited to, ice rinks, tennis courts, golf courses, cricket fields, baseball fields, lacrosse fields, field hockey fields, etc. Further, alternative embodiments may be configured to dispense other physical devices to users, such as tools or other equipment, and may be located conveniently where such devices are used.

The disclosed sporting equipment stick vending machines 100 will become better understood through review of the following detailed description in conjunction with the figures. The detailed description and figures merely provide examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various sporting equipment stick vending machine 100 are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

"Communicatively coupled" means that an electronic device is communicatively connected to another electronic device, either wirelessly or with a wire based connector, whether directly or indirectly through a communication network. "Controllably coupled" means that an electronic device controls operation of another electronic device.

A "sporting equipment stick" 102 is a particular type of sporting equipment used by a player during game play. The sporting equipment stick is defined by a handle, a shaft or shank, and a head. Embodiments of the sporting equipment stick vending machine 100 are configured to dispense various types of sporting equipment sticks now known or later developed, and are intended to be protected by the accompanying claims.

The proximal end of the sporting equipment stick is a handle portion (handle) that is grasped by the player during game play. The handle is of a suitable length for grasping using one hand or two hands, depending upon the nature of the game being played. Some handles may have a fabric or leather outer shell to facilitate the player's grasp and/or to provide comfort.

The middle portion of the sporting equipment stick is a shaft (interchangeably referred to herein as a shank). The shaft is a long, narrow part of the sporting equipment stick connecting the handle to the head. The shaft may be of any suitable length that extends the head out from the handle to some intended distance.

The head is at the distal end of the sporting equipment stick. The head is used by the player to manipulate an object during game play. For example, in ice hockey, the hockey player manipulates a puck using the head of the hockey stick, often referred to as a blade. In baseball, the baseball player uses the head of a baseball bat, referred to as a barrel, to strike a baseball. In tennis, the tennis player uses the head of the racket to strike a tennis ball. In golf, a golfer hits a golf ball using the club head.

Returning to FIG. 1, the sporting equipment stick vending machine 100 comprises a sporting equipment stick dispensing unit 104, optionally secured within a tamper proof and secured enclosure 106. Preferably, an optional access door 108 is provided with an optional viewing window 110. The purchasing user may view the plurality of hockey sticks 102 secured by the sporting equipment stick dispensing unit 104, interchangeably referred to herein as the hockey stick dispensing unit 104. Each individual hockey stick 102 is releasably secured by the hockey stick dispensing unit 104.

In some embodiments, if the secured enclosure 106 is used, the access door 108 remains locked until a purchase has been completed. Here, the purchasing hockey player may view the various secured hockey sticks 102 through the viewing window 110 to identify a particular hockey stick 102 that they wish to purchase. Once a purchase has been completed, a lock that secures the access door 108 is automatically released after payment so that the purchasing user may retrieve their selected hockey stick 102. Other sporting equipment stick vending machines 100 that dispense other types of sporting equipment sticks 102 operate in a similar manner.

In other embodiments, if the secured enclosure 106 is used, the user may open the access door 108 to more closely inspect the plurality of secured hockey sticks 102. In some embodiments, the secured enclosure 106 may not be used. Here, the user may be able to touch the hockey sticks 102 to gain a tactile appreciation of the various individual secured hockey sticks 102. For example, different hockey sticks 102 may have different types of hand grips. Allowing the user to touch the hockey stick may facilitate their selection of a preferred hockey stick 102. Other sporting equipment stick vending machines 100 that dispense other types of sporting equipment sticks 102 operate in a similar manner.

The example sporting equipment stick vending machine 100 includes a payment accepting system 112 that is configured to accept payment for a selected sporting equipment stick 102 that the user wishes to purchase. Any suitable payment accepting system 112 now known or later developed to accept cash and/or electronic payment(s) are intended to be within the scope of this disclosure and to be protected by the accompanying claims.

Additionally, the payment accepting system 112 includes a user interface that enables the user to specify their selected sporting equipment stick 102 of interest. In some embodiments, the payment accepting system 112 employs a plurality of push buttons or other actuators that the user selects to identify the hockey stick 102 that they are interested in purchasing.

Alternatively, or additionally, the payment accepting system 112 incorporates a graphical user interface (GUI) that is configured to receive user input and/or is configured to present various supplemental information and/or cost information pertaining to the various sporting equipment sticks 102 that are currently secured within the sporting equipment stick vending machine 100. For example, the supplemental information may include branding information and/or technical specifications pertaining to an associated hockey stick 102. Alternatively, or additionally, a placard or the like may be located proximate to an associated hockey stick 102 that shows the branding information and/or technical specifications.

Figure 2:
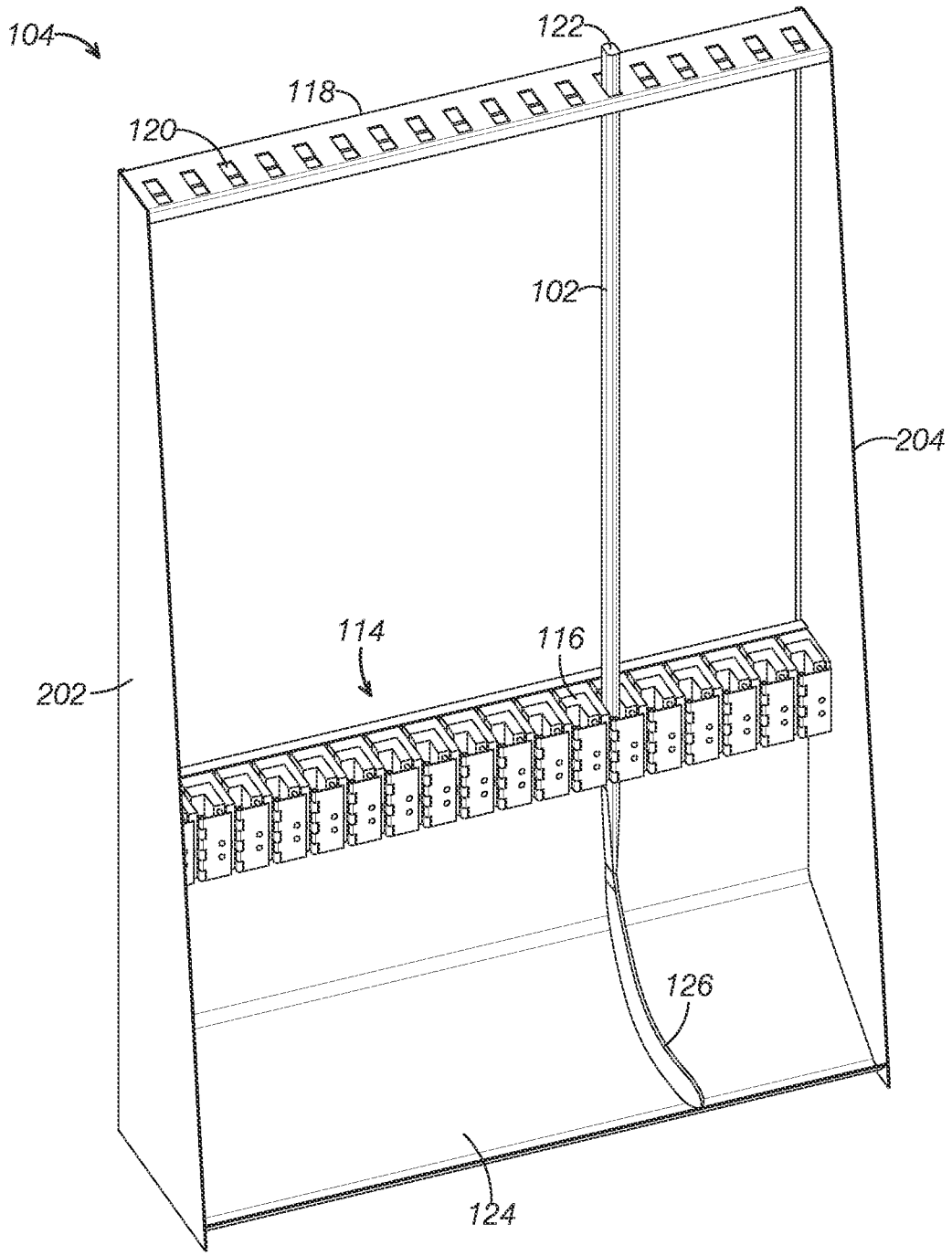
FIG. 2 is a front perspective view of an embodiment of the sporting equipment stick dispensing unit.
Figure 3:
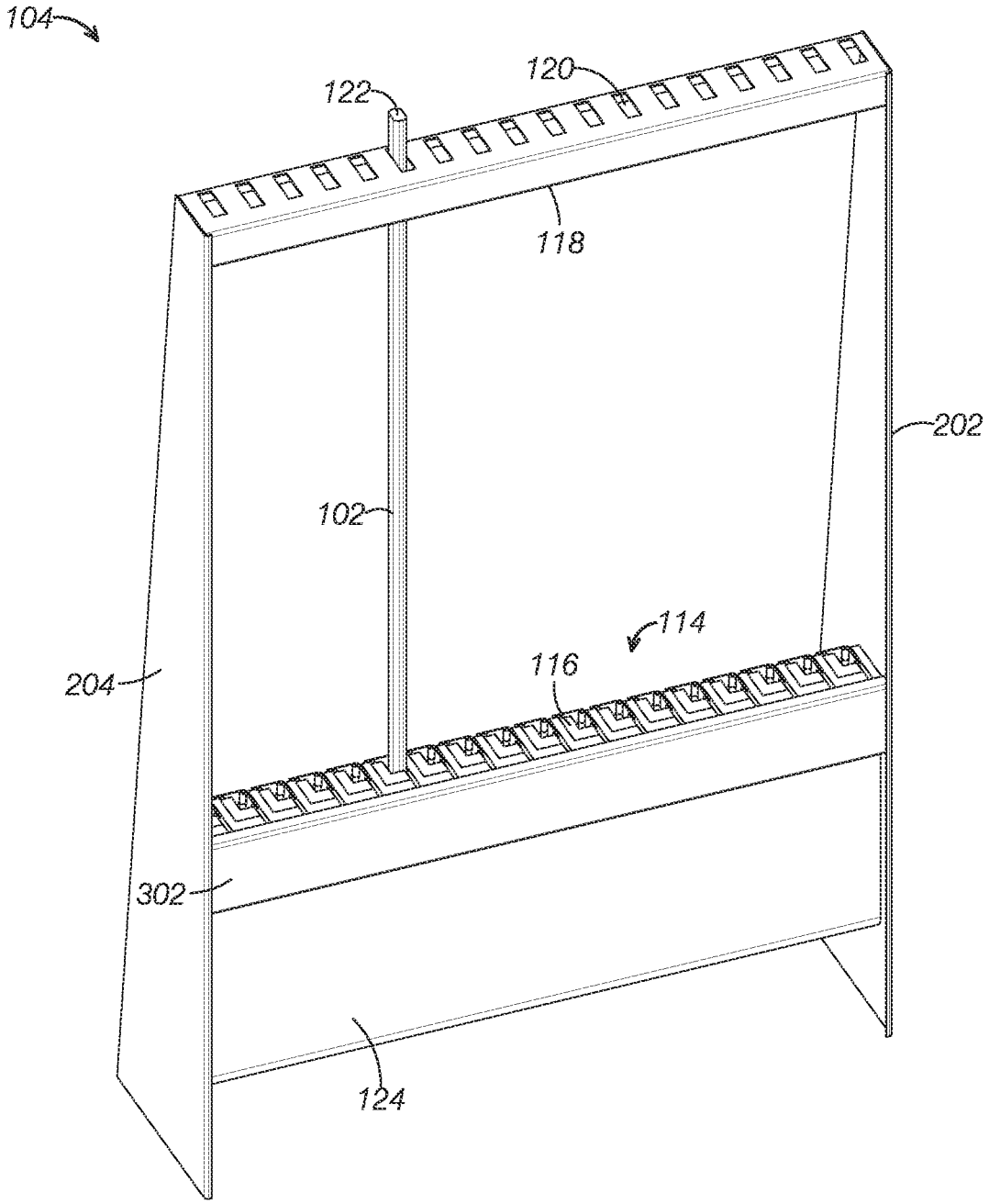
FIG. 3 is a rear perspective view of an embodiment of the sporting equipment stick dispensing unit.

FIG. 2 is a front perspective view of an embodiment of the sporting equipment stick dispensing unit 104. FIG. 3 is a rear perspective view of an embodiment of the sporting equipment stick dispensing unit 104. When the sporting equipment stick vending machine 100 is configured to dispense hockey sticks 102, the sporting equipment stick dispensing unit 104 is interchangeably referred to herein as a hockey stick dispensing unit 104.

Preferably, each of the plurality of sporting equipment sticks 102, such as the example hockey stick 102, are aligned vertically within sporting equipment stick vending machine 100. The sporting equipment sticks 102 are secured using a novel dual point (two point) vending machine restraint system that secures a sporting equipment stick 102 in place within the sporting equipment stick vending machine 100. When secured, the sporting equipment sticks 102 are theft proof. Preferably, the position of the stick guide system 118 is adjustable to facilitate the loading of the sporting equipment stick dispensing unit 104 with sporting equipment sticks 102, and to accommodate sporting equipment sticks 102 of different lengths.

A first point of contact is at the securing latch system 114. The securing latch system 114 is comprised of a horizontal row of adjacent securing latches 116 secured to a support member 302 that extends from a first side wall 202 and a second side wall 204. In some embodiments, the support member 302 and the game stick head rest 124 are fabricated as a unibody piece of material, such as a plastic material or a suitable metal.

Preferably, each securing latch 116 defines a lockable compartment that receives a portion of the shaft of a single sporting equipment stick 102. The securing latch 116 releasably secures the sporting equipment stick 102 within the sporting equipment stick vending machine 100. When the securing latch 116 is released in response to payment from the purchasing user, the sporting equipment stick 102 secured by that particular releasing securing latch 116 may be removed by the user.

A second contact point is provided by a stick guide system 118. Preferably, the stick guide system 118 is located above the securing latch system 114. The stick guide system 118 defines a series of restraining apertures 120 configured to receive a proximal end 122 of the handle of the sporting equipment stick 102 (interchangeably referred to herein as a handle portion of the sporting equipment stick 102). The game player grasps the handle during game play. In alternative embodiments, the stick guide system 118 may lie below the securing latch system 114.

In the illustrated preferred embodiment, each restraining aperture 120 is oriented directly above, and is aligned with, a corresponding one of the securing latches 114. The securing latch 116 is separated by its corresponding restraining aperture 120 by some predefined distance that is long enough so that the sporting equipment stick 102 cannot be removed from the game stick dispensing unit 104 while the securing latch 116 remains secured.

An optional third point of contact is at a game stick head rest 124. Gravity maintains the sporting equipment sticks 102 in place within the sporting equipment stick dispensing unit 104. Here, the distal end 126 of the sporting equipment stick 102 rests on the surface of the game stick head rest 124. Preferably, the game stick head rest 124 is located at the bottom region of the sporting equipment stick dispensing unit 104. The securing latch 116 is separated by the corresponding portion of the game stick head rest 124 by some predefined distance that is short enough so that the sporting equipment stick 102 cannot be removed from the sporting equipment stick dispensing unit 104 while the securing latch 116 remains secured.

The game stick head rest 124, when the sporting equipment stick dispensing unit 104 is configured to dispense hockey sticks 102, is referred to as the hockey stick blade rest 124. In the illustrated embodiment, the hockey stick blade rest 124 is optionally shaped to conform with the shape of the blade 126 of the hockey stick 102. The conforming shape of the hockey stick blade rest 124 supports the hockey stick blade 126 along the lower edge of the playing surface of the blade, thereby eliminating, or substantially reducing, any potential warpage of the hockey stick 102 during its stay in the sporting equipment stick vending machine 100.

When other types of sporting equipment sticks are secured by the sporting equipment stick vending machine 100, the head rest 124 is preferably shaped to support the head of that particular type of sporting equipment stick. For example, if a tennis racket is secured within the sporting equipment stick vending machine 100, then a portion of the head rest 124 may be concave so as to provide support to the head of the tennis racket. The securing latch 116 may be configured to secure the throat and/or lower part of the handle of the tennis racket. The restraining aperture 120 may be sized to receive the end of the tennis racket handle.

As another example, baseball bats may be secured in a sporting equipment stick vending machine 100. Here, a portion of the head rest 124 may be shaped so as to provide support to the end of the barrel of the baseball bat. The securing latch 116 may be configured to secure the handle and/or the lower part of the grip of the baseball bat. The restraining aperture 120 may be sized to receive the knob of the baseball bat.

Embodiments of the sporting equipment stick vending machine 100 may be configured to secure and dispense other types of sporting equipment sticks. Further, at multi-sports venues, the sporting equipment stick vending machine 100 may be configured to secure and dispense a plurality of different types of sporting equipment sticks. For example, at facility that provides multiple playing fields, the sporting equipment stick vending machine 100 may be configured to dispense baseball bats, lacrosse sticks, and/or field hockey sticks. Here, the restraining apertures 120, the securing latches 116 and the head rests 124 may be selectively sized and/or spaced apart to receive and secure a particular sporting equipment stick type.

Optionally, the securing latches 116 may be configured to grasp and secure the shaft of the sporting equipment stick 102. Here, the securing latch 116 frictionally secures the sporting equipment stick 102 when in the secured or locked position.

Figure 4:
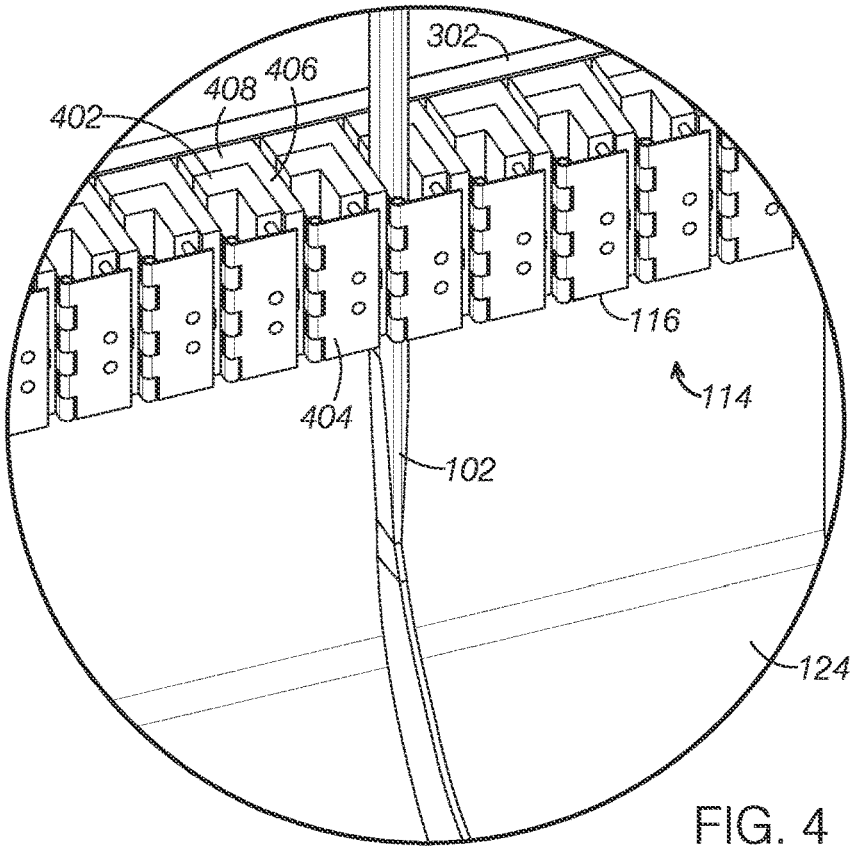
FIG. 4 is an example embodiment of the securing latch of the sporting equipment stick vending machine in a secured or locked position.
Figure 5:
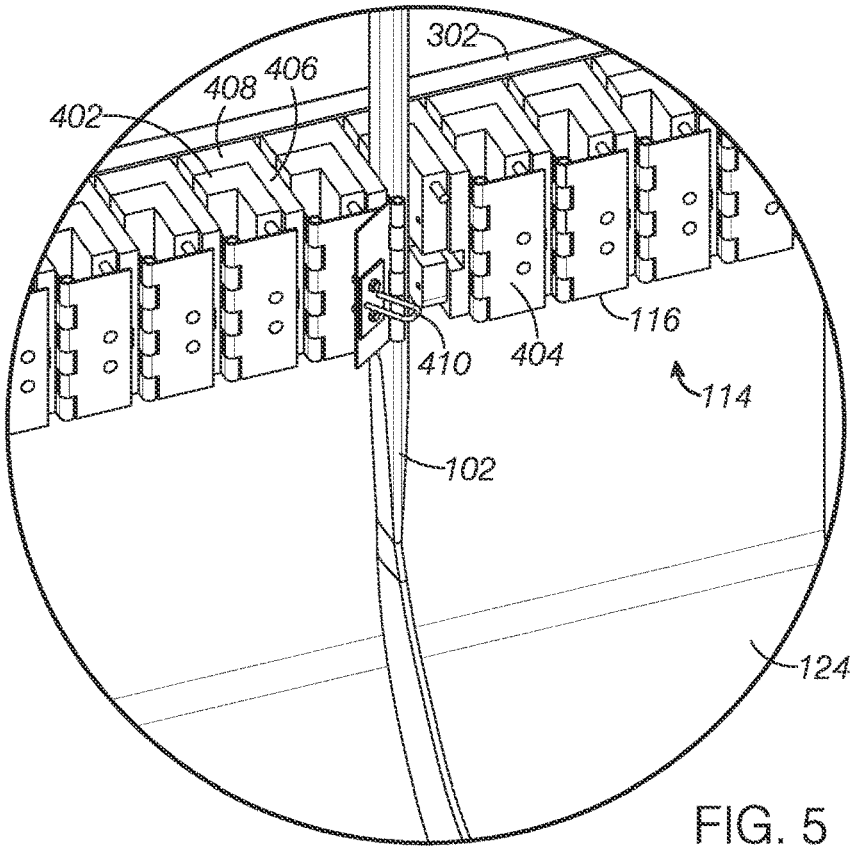
FIG. 5 is the example embodiment of the securing latch in a released or opened position.
Figure 6:
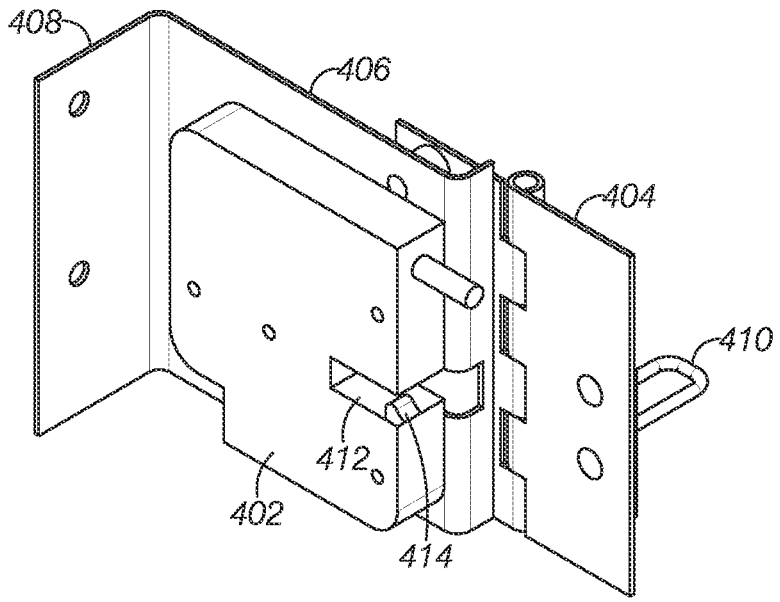
FIG. 6 is a perspective view of the securing latch in an opened position.
Figure 7:
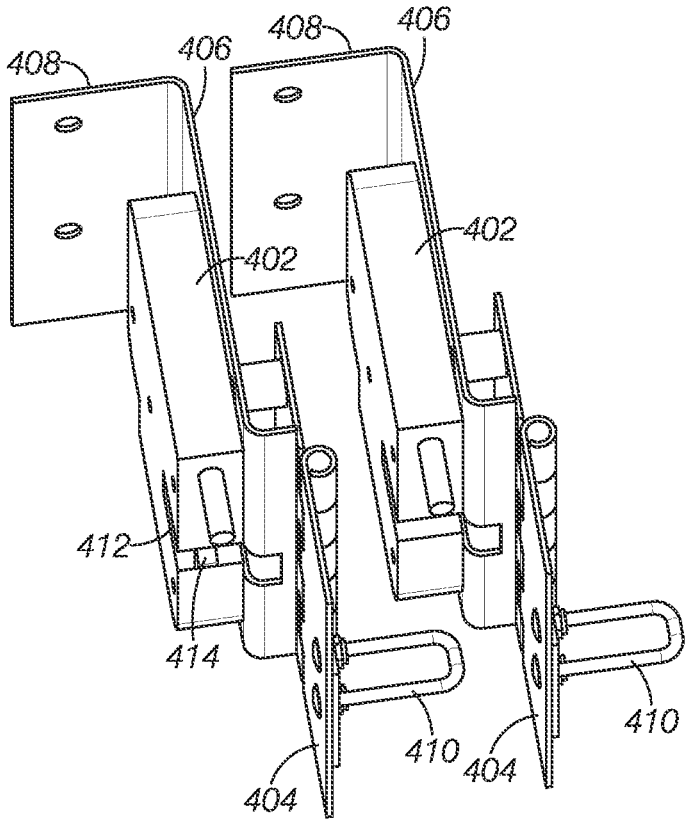
FIG. 7 is a perspective view of two adjacent securing latches each in an opened position.

FIG. 4 is an example embodiment of the securing latch 116 of the sporting equipment stick vending machine 100 in a secured or locked position. FIG. 5 is the example embodiment of the securing latch 116 in a released or opened position. FIG. 6 is a perspective view of the securing latch 116 in the opened position. FIG. 7 is a perspective view of two adjacent securing latches 116 each in the opened position.

This example embodiment of a securing latch 116 comprises a lock mechanism 402, a hinged door 404, a side wall member 406, a back wall member 408, and lock latch 410. The back wall member 408 is secured to the support member 302 (FIG. 3) so that the side wall member 406 extends outwardly from the support member 302 of the securing latch system 114. A surface of a proximal side of the hinged door 404 is secured to the outer surface of the side wall member 406.

The lock mechanism 402 is an electromechanical device, such as an electric lock latch, that is secured to an inside surface of the side wall member 406. The lock mechanism 402 is aligned such that the hook latch engagement portion is aligned with the outer edge of the side wall member 406. Any suitable electromechanical locking devices now known or later developed are intended to be within the scope of this disclosure and to be protected by the accompanying claims.

A lock latch 410 is secured to a distal outside surface of the hinged door 404 proximate to the outer edge of the side wall member 406. The lock latch 410 extends outwardly from the hinged door 404 and is aligned to be received by the engagement slot 412 of the lock mechanism 402.

As shown in FIG. 7, a series of securing latch systems 114 are secured to the support member 302 in an aligned serial fashion to form the securing latch system 114. When an adjacent hinged door 404 with the lock latch 410 is rotated to the closed position, the lock latch 410 then enters into an engagement slot 412 of the body of the adjacent lock mechanism 402.

In an example embodiment, the lock mechanism 402 is an electronically controlled rotary latch. When the rotary latch 402 is actuated into a lock mode, as depicted in FIG. 4, the rotary latch 402 extends a lock tongue 414 that engages with a distal end of the lock latch 410 that has been inserted into the engagement slot 412. When the rotary latch 402 is actuated into an open or latch release mode, as depicted in FIG. 5, the lock tongue is retracted, thereby releasing the lock latch 410 from the rotary latch 402.

Some rotary latches 402 include a push pin 416. When the hinged door 404 is in the closed position, the push pin 416 is retracted into the body of the lock mechanism 402. When the lock mechanism 402 is released, the push pin 416 pushes the hinged door 404 and the lock latch 410 outward and away from the lock mechanism 402. In some embodiments, a spring is used to extend the push pin 416 outward from the body of the lock mechanism 402. Alternatively, an electromechanical device, such as but not limited to a solenoid, may be used to extend the push pin 416.

When the lock mechanism 402 is actuated into the open or latch release mode, the purchasing user is able to pull the lower portion of the hockey stick 102 outward and away from the hockey stick rest 110 and the securing latch 116. The restraining aperture 120 of the stick guide system 118 is sufficiently large enough to allow for the outward pivoting of the hockey stick 102 such that the user may then slide the hockey stick 102 downward. As the user slides the hockey stick 102 downward and outward, the proximal end 122 of the handle of the hockey stick 102 may be pulled through the restraining aperture 120, thereby dispensing the hockey stick 102 to the user.

Figure 10:
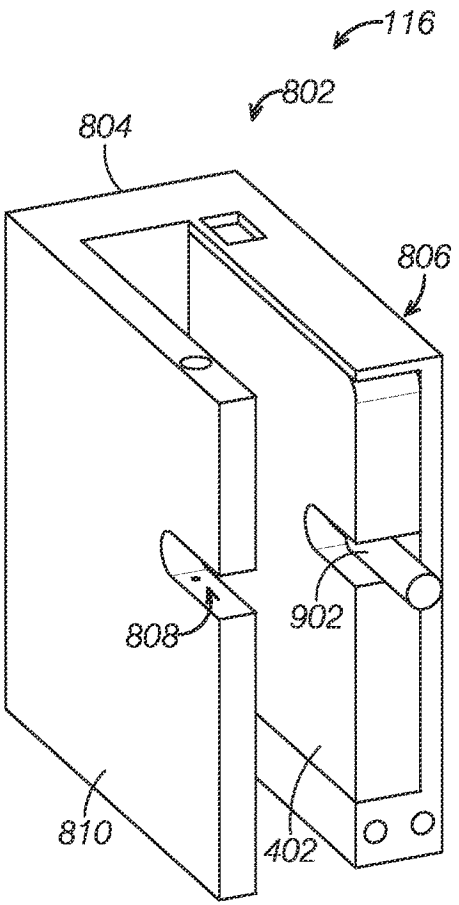
FIG. 10 is a perspective view of the securing latch in a released or open position.
Figure 9:
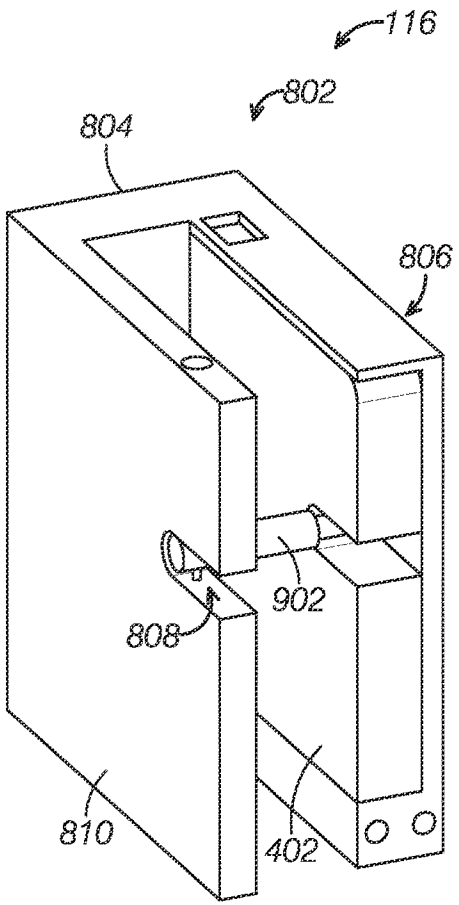
FIG. 9 is a perspective view of the securing latch in a secured or locked position.
Figure 8:
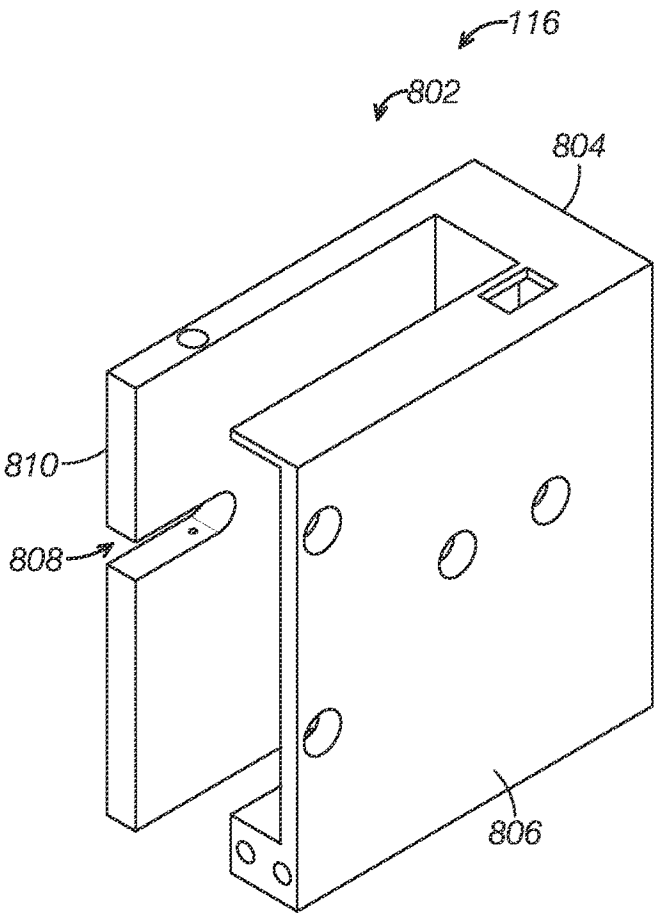
FIG. 8 is a perspective view of an alternative embodiment of a securing latch.
Figure 11:
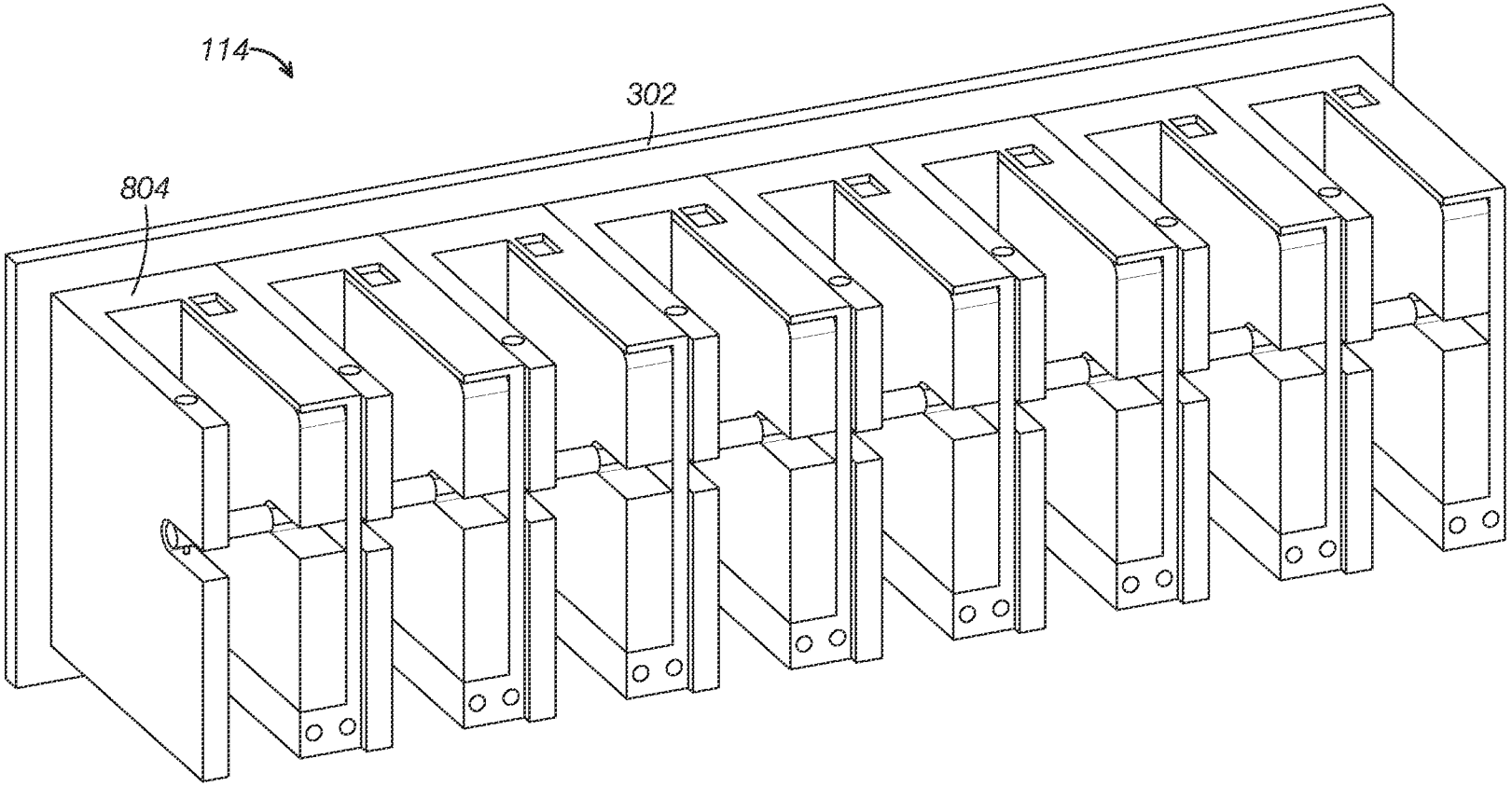
FIG. 11 is a perspective view of a series of securing latches arranged to form the securing latch system.

FIG. 8 is a perspective view of an alternative embodiment of a securing latch 802. FIG. 9 is a perspective view of the securing latch 802 in a secured or locked position. FIG. 10 is a perspective view of the securing latch 802 in a released or open position. FIG. 11 is a perspective view of a series of securing latches 802 arranged in an aligned serial fashion to form the securing latch system 114.

The securing latch 802 comprises a body 804 and a securing latch 116 that is secured on an inside surface of a wall 806 of the body 804. An engagement slot 808 is defined at an outer edge on the opposing wall 810 of the body 804. The engagement slot is configured to receive a distal end of a locking pin 902 that is moved (rotated) into place when the securing latch 802 is actuated into the secure or locked position as illustrated in FIG. 9. When the end of the locking pin 902 is engaged with or resides in the engagement slot 808, the lockable compartment of the securing latch 802 receives a portion of the shaft of a single sporting equipment stick 102. The locking pin 902, the side walls of the body 806, 810, and the back wall 804 of the body cooperatively define the lockable compartment of the securing latch 802. Accordingly, the secured sporting equipment stick 102 cannot be removed while the securing latch 802 is operated in the secured or locked position.

In an example securing latch 802, the securing latch 802 is an electromechanical device. When a lock control signal is received, the securing latch 802 rotates a proximal end of the locking pin 902 outwardly from the body of the securing latch 802 so that a distal end of the locking pin 902 is received into the engagement slot 808. When a release control signal is received, the securing latch 802 rotates the locking pin 902 in the opposite direction so that the lockable compartment is opened. Then, the sporting equipment stick 102 can be removed from the sporting equipment stick vending machine 100 by the purchasing user.

Figure 12:
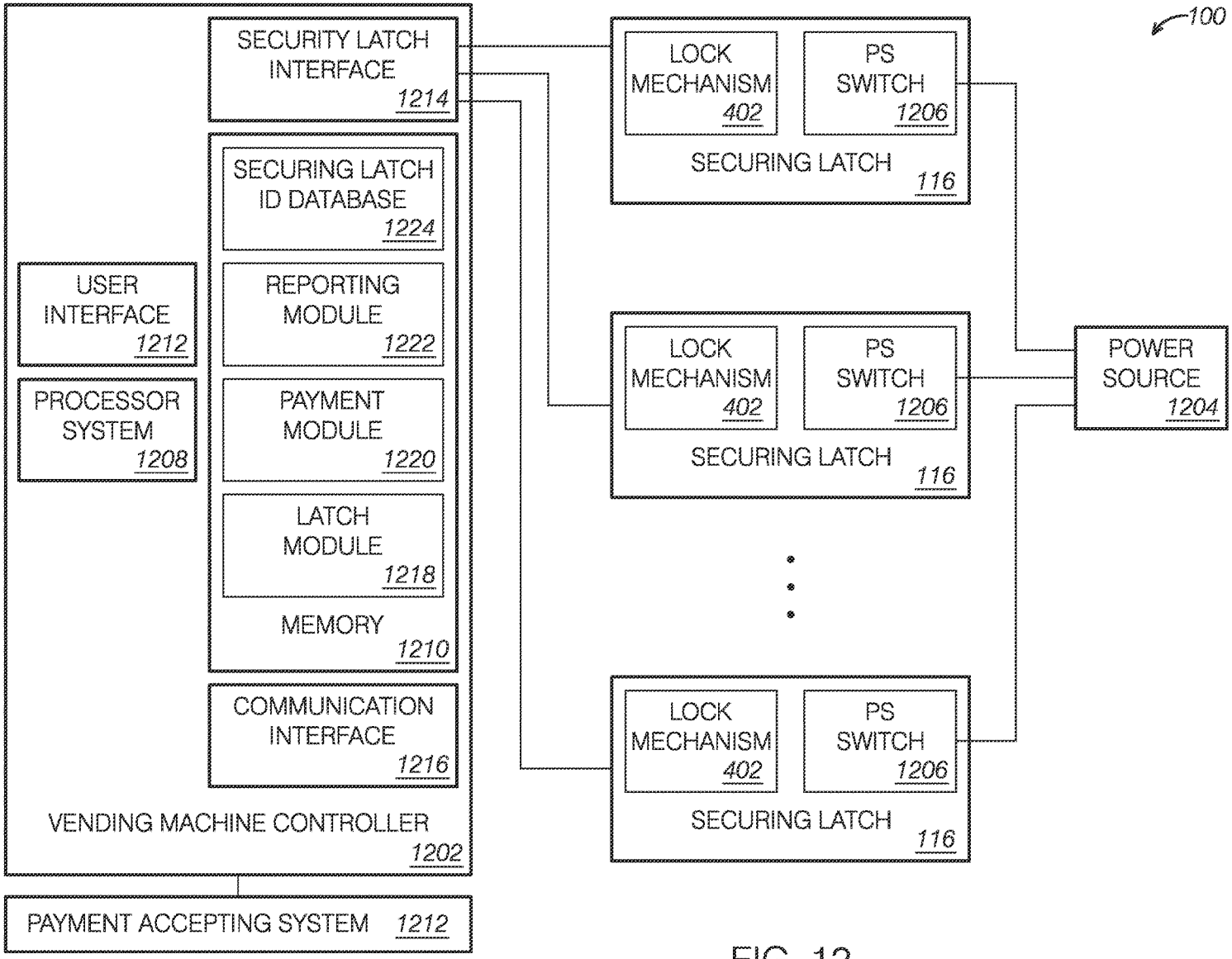
FIG. 12 is a block diagram of a vending machine control system embodiment that controls the sporting equipment stick vending machine.

FIG. 12 is a block diagram of a vending machine controller 1202 embodiment that controls the sporting equipment stick vending machine 100. The vending machine controller 1202 provides control signals that secure (close) or release (open) the individual securing latches 116 in response to a user purchasing a selected one of the sporting equipment sticks 102. Each of the securing latches 116 are electromechanical devices that receive power from a power source 1204. In an example embodiment, each securing latch 116 includes a power semiconductor (PS) switch 1206. When a selected one of the securing latches 116 is actuated to secure or release, the vending machine controller 1202 sends a control signal to the power semiconductor switch 1206. The power semiconductor switch 1206 then provides the securing latch 116 power from the power source 1204 to open or close.

The vending machine controller 1202 comprises a processor system 1208, a memory 1210, a user interface 1212, a security latch interface 1214 and an optional communication interface 1216. The memory 1210 comprises portions for storing the latch module 1218, the payment module 1220, the optional reporting module 1222, and a securing latch identification (ID) database 1224. In some embodiments, latch module 1218, the payment module 1220, and the optional reporting module 1222 may be integrated together, and/or may be integrated with other logic. In other embodiments, some or all of these memory and other data manipulation functions may be provided by using a remote server or other electronic devices suitably connected via the Internet or otherwise to a client device. Other vending machine controllers 1202 may include some, or may omit some, of the above-described components. Further, additional components not described herein may be included in alternative embodiments.

The memory 1210 stores the unique identifier (ID) of each individual securing latch 116 in the securing latch database 1224. When the user specifies the sporting equipment stick 102 of interest that they wish to purchase, via the user interface 1212, the vending machine controller 1202 identifies the particular securing latch 116 that is securing the selected sporting equipment stick 102 based on the ID.

The vending machine controller 1202, executing the payment module 1222 logic, processes payment made by the purchasing user via the payment accepting system 112 (FIG. 1). In some embodiments, the user interface 1212 is an integrated component of the payment accepting system 112, In some embodiments, the communication interface 1216 is communicatively connected to the Internet or another suitable communication system so that payment processing can be verified and/or completed by the vending machine controller 1202.

Then, using the latch module 1218 logic that is executed by processor system 1306, the vending machine controller 1202 communicates a release control signal, via the security latch interface 1214, to the identified securing latch 116. In response to receiving the release signal, the identified securing latch 116 releases (opens). Any suitable electromechanical actuator now known or later developed may be used for releasing the securing latch 116. [70] In some embodiments, the optional reporting module 1222 generates inventory reports and other reports of interest that are communicated to a remote device, such as a computer, server, smart phone or the like. Accordingly, operators of the sporting equipment stick vending machine 100 can obtain information about purchases and inventory.

In an alternative embodiment, by modifying the lock housing, the design can be changed from a single stick bay to a multi stick bay allowing a securing latch 116, 802 to stock more sporting equipment sticks 102 into one bay. In another embodiment, by modifying the latch hinge system into a full-length door system, each door would run the full length of the sporting equipment stick 102 containing a polycarbonate or tempered glass window, allowing a viewing of each sporting equipment stick 102, and providing additional security. Another embodiment would be to have a split, polycarbonate window/door design. The window/door design would preferably extend the full length of the sporting equipment stick vending machine 100. The doors would be automated and open in the middle of the machine, and the securing latch 116, 802 would release when the sporting equipment stick 102 has been purchased.

One skilled in the art of vending machine technologies appreciates that a legacy vending machine is able to dispense various items to a purchasing user. In some situations, a legacy vending machine may be available at the vending site that may be modifiable to be controllable coupled to the securing latch system 114.

Alternatively, a stand-alone kiosk 1302 or the like may be substituted for the modified legacy vending machine 1302 to control the securing latch system 114. Here, the modified legacy vending machine 1302 and/or the kiosk 1302 may be configured to control any number of sporting equipment stick vending machines 100 and/or securing latches 116, 802.

Figure 13:
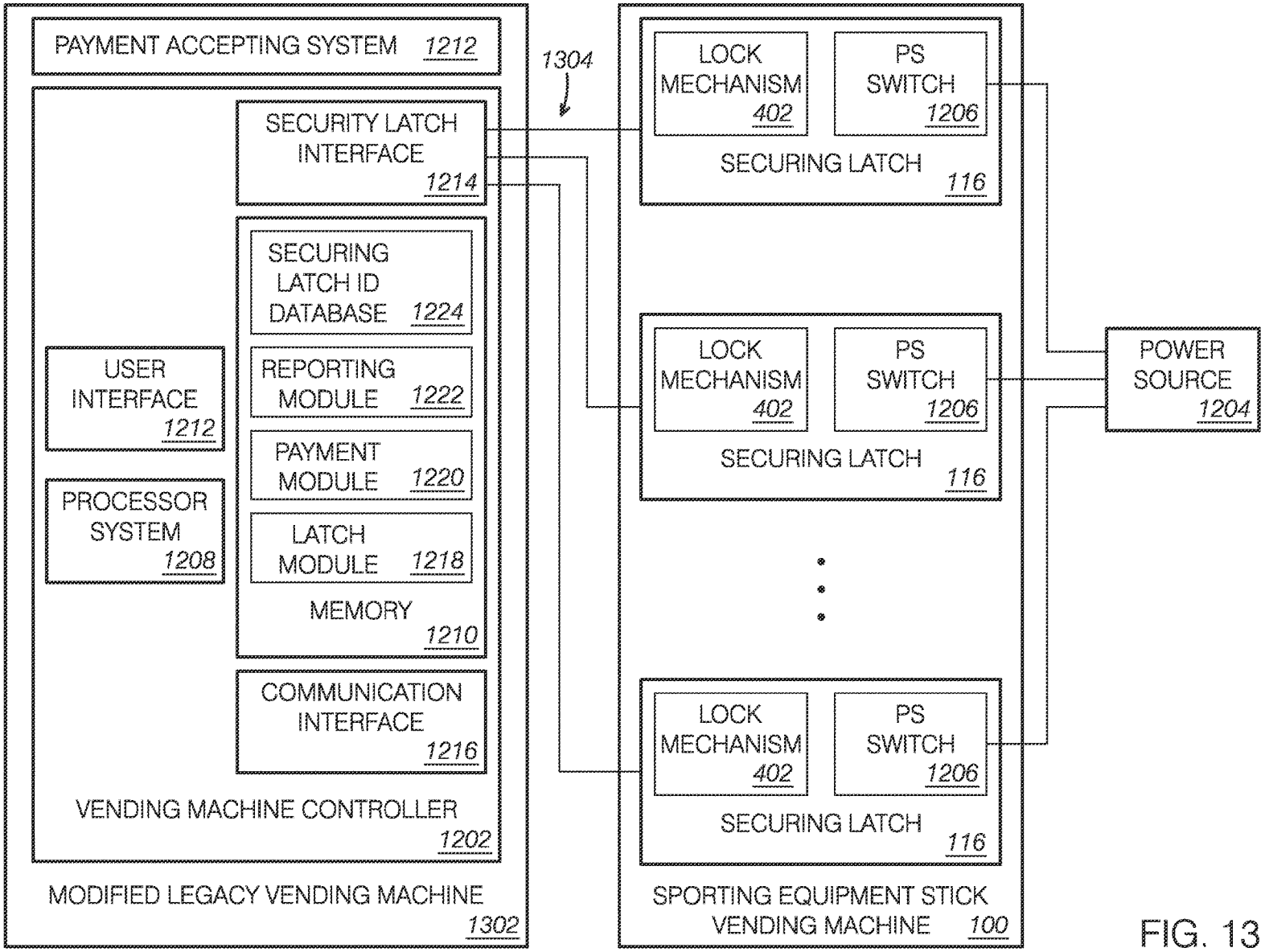
FIG. 13 is a block diagram of a legacy vending machine that is controllably coupled to an embodiment of the sporting equipment stick vending machine.

FIG. 13 is a block diagram of a legacy vending machine 1302 that is controllably coupled to an embodiment of the sporting equipment stick vending machine 100. Like components described above with respect to FIG. 12 are identified using like references numerals and are not described again for brevity.

A user interface 1212 and controller 1202 resides in a legacy vending machine 1302. The user interface 1212 receives a user request/specification that identifies an item of interest that is available from the legacy vending machine. Typically, the purchaser specifies the item by entering an identification number (ID), via the user interface, that is associated with the item of interest. Alternatively, the purchaser may actuate (press, push or touch) a controller that is associated with the item of interest. After the purchaser pays for the specified item of interest, that item is dispended by the legacy vending machine 1302.

In this alternative embodiment, the securing latches 116 of the sporting equipment stick vending machine 100 are controllably coupled to a modified legacy vending machine 1302 that has been modified to control the sporting equipment stick vending machine 100. The legacy vending machine controller 1202 is accessed and is modified (or is replaced by a new modified controller) so that the modified legacy vending machine 1302 becomes configured to control the securing latches 116 residing in one or more vending machines 100. As noted herein, each securing latch 116 preferably secures and retains a single sporting equipment stick 102. Each securing latch 116 is uniquely identified by an ID, such as a numeral or the like. In an example embodiment, each one of the securing latches 116 are controllably coupled to the modified legacy vending machine 1302 via a control wire 1304. In an alternative embodiment, the securing latches 116, 802 are controllably coupled to the modified legacy vending machine via a suitable wireless connection, such as a near field communication connection. A nonlimiting example near filed communication system is WiFi.

In practice, the sporting equipment stick vending machine 100 would be placed adjacent to, or in close proximity to, the modified legacy vending machine 1302. The purchasing user may use the user interface 1212 of the modified legacy vending machine to select a sporting equipment stick 102 for purchase, and/or use the payment accepting system of the modified legacy vending machine to pay for the selected sporting equipment stick 102.

When the purchaser has paid for their sporting equipment stick 102, the controller of the modified legacy vending machine communicates a release signal that is received by the associated securing latch 116. In response to receiving the release signal, the securing latch 116 releases. The purchaser may then remove the selected sporting equipment stick 102 from the sporting equipment stick vending machine 100.

An unexpected advantage provided by embodiments of the sporting equipment stick vending machine 100 is that since the modified legacy vending machine controls each of the securing latches 116 using the user interface and controller of the modified legacy vending machine 1302, embodiments of the sporting equipment stick vending machine 100 do not need their own independent user interface, payment accepting system, and/or controller. Accordingly, construction of embodiments of the sporting equipment stick vending machine 100 are simplified and fabrication costs can be minimized.

Embodiments of the sporting equipment stick vending machine 100 are scalable to accommodate any number and/or types of sporting equipment sticks 102 and/or other objects that may be dispensed. For example, any suitable number of securing latches 116, 802 can be provided in a sporting equipment stick vending machine 100. Multiple sporting equipment stick vending machines 100 may be placed next to each other, or in close proximity to the modified legacy vending machine, wherein all vending machines 100 are controlled by the modified legacy vending machine.

It should be emphasized that the above-described embodiments of the sporting equipment stick vending machines 100 are merely possible examples of implementations of the invention. Many variations and modifications may be made to the above-described embodiments. All such modifications and variations are intended to be included herein within the scope of this disclosure and protected by the following claims.

Furthermore, the disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower, or equal in scope to the original claims, are to be considered within the subject matter of the inventions described herein.

The invention claimed is:

1. A sporting equipment stick vending machine that dispenses a plurality of sporting equipment sticks, comprising:

a controller, wherein the controller is configured to generate a release signal in response to a user completing a purchase of a selected sporting equipment stick that is secured within the sporting equipment stick vending machine;

a plurality of securing latches controllably coupled to the controller, wherein each securing latch defines a lockable compartment that is configured to receive a portion of a shaft of a sporting equipment stick, wherein each securing latch is an electromechanical device that is configured to releasably secure the corresponding sporting equipment stick, and wherein each one of the plurality of securing latches are configured to open to release its respective sporting equipment stick in response to the release signal received from the controller; and a stick guide system, wherein the stick guide system defines a plurality of restraining apertures that are configured to receive a portion of a handle of the sporting equipment stick, and wherein a size of each restraining aperture is sized to receive a proximal end of the sporting equipment stick, wherein the securing latch and the corresponding restraining aperture of the stick guide system cooperatively secure the selected sporting equipment stick within the sporting equipment stick vending machine when the securing latch is closed, wherein the securing latch securing the selected sporting equipment stick releases the selected sporting equipment stick in response to receiving the release signal from the controller, and wherein the user is able to remove the selected sporting equipment stick from the sporting equipment stick vending machine after the securing latch releases the selected sporting equipment stick.

2. The sporting equipment stick vending machine of claim 1, wherein the plurality of sporting equipment sticks secured within the sporting equipment stick vending machine are each defined by a handle, the shaft, and a head, wherein a proximal end of the sporting equipment stick is the handle that is grasped by a player during game play, wherein the shaft is a long, narrow middle portion of the sporting equipment stick connecting the handle to the head, and wherein the head is at a distal end of the sporting equipment stick and head is used by the player to manipulate an object during game play.

3. The sporting equipment stick vending machine of claim 1, wherein the sporting equipment stick vending machine is configured to secure a plurality of hockey sticks, and wherein the selected sporting equipment stick is a selected hockey stick.

4. The sporting equipment stick vending machine of claim 3, further comprising:

a hockey stick blade rest oriented below the plurality of securing latches, wherein a blade of the hockey stick rests upon and is supported by the hockey stick blade rest when secured by the securing latch and the corresponding restraining aperture of the stick guide system.

5. The sporting equipment stick vending machine of claim 4, wherein the hockey stick blade rest has a shape that corresponds to a bottom edge of the hockey stick blade.

6. The sporting equipment stick vending machine of claim 4, wherein the stick guide system with the plurality of restraining apertures is located above the plurality of securing latches, and wherein the securing latch, the corresponding restraining aperture of the stick guide system, and the hockey stick blade rest cooperatively secure the selected hockey stick within the sporting equipment stick vending machine when the securing latch is closed.

7. The sporting equipment stick vending machine of claim 1, further comprising:

a payment accepting system configured to accept payment for the selected sporting equipment stick, wherein the release signal is communicated for the controller to the securing latch that is securing the selected sporting equipment stick in response to completion of payment for the selected sporting equipment stick.

8. The sporting equipment stick vending machine of claim 1, wherein the securing latch securing the selected sporting equipment stick is an electromechanical device that is responsive to the release signal received from the controller.

9. The sporting equipment stick vending machine of claim 8, wherein the securing latch comprises:

a body, wherein the body is defined by a first side wall, a second side wall and a back wall, wherein an engagement slot is defined at an outer edge of the first side wall;

a lock mechanism secured to the second side wall of the body; and a locking pin, wherein when the securing latch is in a closed position, the lock mechanism rotates a proximal end of the locking pin so that a distal end of the locking pin moves outwardly from the body of the securing latch, wherein the distal end of the locking pin is received into the engagement slot, and wherein the locking pin, the first side wall of the body, the second side wall of the body, and the back wall of the body cooperatively define the lockable compartment of the securing latch.

10. The sporting equipment stick vending machine of claim 9, further comprising:

a support member that extends from a first side wall and a second side wall of the sporting equipment stick vending machine, wherein the back wall of the body of each of the plurality of securing latches are secured to the support member in a serial fashion along a length of the support member.

11. The sporting equipment stick vending machine of claim 8, wherein each of the plurality of securing latches comprises:

a back wall member;

a side wall member extending outwardly from the back wall member;

a lock mechanism secured to an inside surface of the side wall member, wherein an outer edge of the lock mechanism is aligned with an outer edge of the side wall member, and wherein an engagement slot is defined in the outer edge of the lock mechanism;

a hinged door secured to an outside surface of the side wall member; and a lock latch secured to the hinged door, wherein the lock latch protrudes outwardly from the hinged door, and wherein the lock latch is aligned to be received within the engagement slot or the lock mechanism, wherein when the securing latch is in a closed position, a distal end of the lock latch is received in the engagement slot of an adjacent lock mechanism, and wherein when the securing latch is in a closed position, the adjacent lock mechanism moves a lock tongue to engage and secure the distal end of the lock latch.

12. The sporting equipment stick vending machine of claim 11, wherein the side wall member of the securing latch, the back wall member of the adjacent securing latch, the lock mechanism of the adjacent securing latch, and the hinged door of the securing latch cooperatively define the lockable compartment.

13. The sporting equipment stick vending machine of claim 12, further comprising:

a support member that extends from a first side wall and a second side wall of the sporting equipment stick vending machine, wherein the back wall member of each of the plurality of securing latches are secured to the support member in a serial fashion along a length of the support member.

14. The sporting equipment stick vending machine of claim 1, further comprising:

a head rest oriented below the plurality of securing latches, wherein the head of the sporting equipment stick rests upon and is supported by the head rest when secured by the securing latch and the corresponding restraining aperture of the stick guide system.

15. The sporting equipment stick vending machine of claim 14, wherein the head rest has a shape that corresponds to a shape of the head of the sporting equipment stick.

16. The sporting equipment stick vending machine of claim 15, wherein the sporting equipment stick is a tennis racket, and wherein a portion of the head rest is concave so as to provide support to the head of the tennis racket, wherein the securing latch is configured to secure a throat of the tennis racket, and wherein the restraining aperture is sized to receive an end of the tennis racket handle.

17. The sporting equipment stick vending machine of claim 15, wherein the sporting equipment stick is a baseball bat, and wherein a portion of the head rest is shaped so as to provide support to an end of a barrel of the baseball bat, wherein the securing latch is configured to secure a handle of the baseball bat, and wherein the restraining aperture is sized to receive a knob and portion of a handle of the baseball bat.

18. The sporting equipment stick vending machine of claim 14, wherein the sporting equipment stick with the plurality of restraining apertures is located above the plurality of securing latches, and wherein the securing latch, the corresponding restraining aperture of the stick guide system, and the head rest cooperatively secure the selected sporting equipment stick within the sporting equipment stick vending machine when the securing latch is closed.

19. A hockey stick vending machine system for dispensing a plurality of sporting equipment sticks, comprising:

a modified legacy vending machine, comprising:

a controller;

a user interface that is configured to receive a selection of a sporting equipment stick from a user; and a payment accepting system configured to receive payment for the selected sporting equipment stick; and a sporting equipment stick vending machine, comprising:

a plurality of securing latches controllably coupled to the controller of the modified legacy vending machine, wherein each one of the plurality of securing latches secures one of the sporting equipment sticks within the sporting equipment stick vending machine, and wherein each one of the plurality of securing latches are configured to open to release its respective selected sporting equipment stick in response to a release signal received from the controller of the modified legacy vending machine; and a stick guide system, wherein the stick guide system defines a plurality of restraining apertures that are configured to receive a portion of a handle of the sporting equipment stick, and wherein a size of each restraining aperture is sized to receive a proximal end of the sporting equipment stick, wherein the securing latch and the corresponding restraining aperture of the stick guide system cooperatively secure the selected sporting equipment stick within the sporting equipment stick vending machine when the securing latch is closed, wherein the controller of the modified legacy vending machine transmits the release signal after the user has completed purchase of the selected sporting equipment stick using the payment accepting system of the modified legacy vending machine, and wherein the user is able to remove the selected sporting equipment stick from the sporting equipment stick vending machine after the securing latch releases the selected sporting equipment stick.

* * * * *